US007377249B1

(12) United States Patent
Dingle

(10) Patent No.: US 7,377,249 B1
(45) Date of Patent: May 27, 2008

(54) OUTWARD-OPENING GAS-EXCHANGE VALVE SYSTEM FOR AN INTERNAL COMBUSTION ENGINE

(75) Inventor: Philip J. G. Dingle, Rochester, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/725,345

(22) Filed: Mar. 19, 2007

(51) Int. Cl.
*F02N 3/00* (2006.01)
*F01L 1/28* (2006.01)

(52) U.S. Cl. ..... 123/188.8; 123/79 R

(58) Field of Classification Search ..... 123/79 R, 123/188.8, 188.17, 90.12, 90.14
See application file for complete search history.

(56) References Cited

U.S. PATENT DOCUMENTS

| | | | | |
|---|---|---|---|---|
| 5,522,358 | A | 6/1996 | Clarke | |
| 5,709,178 | A | 1/1998 | Feucht | |
| 5,819,693 | A | 10/1998 | Curtil | |
| 6,223,846 | B1 | 5/2001 | Schechter | |
| 7,104,230 | B2 * | 9/2006 | Fujii et al. | 123/90.16 |
| 7,200,889 | B2 * | 4/2007 | Vohra | 15/88.2 |

OTHER PUBLICATIONS

Regueiro, Jose F. and Kosina, Vladimir; "Rotular Tappet Valve Trains for Hemispherical Combustion Chambers"; SAE Technical Paper Series 960058; Reprinted from: Applications of New Diesel Engine and Component Design (SP-1158); International Congress & Exposition; Detroit, MI; Feb. 26-29, 1996.

Mello, J. P., and Linna, J.R.; "Homogeneous Charge Compression Ignition (HCCI)—The Pathway to Clean Diesel Engines?"; TIAX, LLC; Cambridge, Mass; Jan. 30, 2003.

* cited by examiner

*Primary Examiner*—John T. Kwon
(74) *Attorney, Agent, or Firm*—Paul L. Marshall

(57) ABSTRACT

An outwardly-opening gas-exchange valve assembly for an internal combustion engine. The valve assembly includes a port in a firing chamber in an engine head, the port having a valve seat on a side opposite from the firing chamber. A piston-shaped poppet valve head slides in a bore in the engine head for mating with the valve seat to occlude passage of gas across the valve seat. Withdrawal of the poppet valve head from the seat opens the firing chamber to communication with an intake or exhaust manifold runner in the engine head. The poppet valve head may be actuated by an overcenter lever arrangement actuated selectively by hydraulic pressure or mechanical actuation. In a preferred embodiment, OO intake and exhaust valves are radially arranged in a hemispherical fire deck and may include an adjustable pitch helical channel to induce swirl to the incoming gas.

16 Claims, 9 Drawing Sheets

OUTWARD-OPENING GAS-EXCHANGE VALVE SYSTEM FOR AN INTERNAL COMBUSTION ENGINE

TECHNICAL FIELD

The present invention relates to internal combustion engines; more particularly, to gas-exchange valves for introducing and exhausting gases from firing chambers of an internal combustion engine; and most particularly, to a gas-exchange poppet valve wherein in opening the valve a poppet moves away from the engine firing chamber.

BACKGROUND OF THE INVENTION

It is universally accepted that, for any new internal combustion engine design, the use of an inwardly-opening ("IO") poppet for the engine gas-exchange valves is the only sensible architecture to consider. Inwardly opening in this context is taken from the perspective of the engine, and more specifically from the combustion chamber; that is to say, the valves move into the combustion space as they open, rather than away from it. The reasons for this choice are well known, and include the fact that the cylinder pressure acts to improve the valve seat sealing force in a self-assisting manner so that the higher the pressure to be contained, the better the valve is able to seal. Thus, this type of valve has been the standard for well over 100 years and its associated technology has evolved to a high standard.

The following is a list of some of the advantages enjoyed by the inwardly-opening valve (IOV):

- Valve seat sealing force increases in a self-energizing manner with cylinder pressure.
- Design, manufacture, and application are well understood within the industry.
- The valves and their associated valve train components are readily available commodity items.
- It works demonstrably well, and meets its objectives—so well in fact that there is no overwhelming incentive to seek improvement.

This situation notwithstanding, it must be recognized that the inwardly-opening (IO) poppet valve does have some drawbacks, and over the years, alternate designs such as sleeve, rotary, swing, and piston valves have attempted to address these. On every occasion, however, technological improvement to the poppet valve has eventually been able to fight off the challenger, and in so doing, maintain its premier position.

The IOV, however, has some distinct disadvantages, including the following:

- The valve head and stem in the port are a restriction to free gas flow. This may be illustrated by noting that steady state flow testing of cylinder heads with the valve in place (at full lift) generally give lower values than those obtained under identical conditions but with the valve removed. Note that the difference between the theoretical flow through a perfect orifice and the actual flow is given as the Coefficient of Discharge ($C_d$), e.g. a typical $C_d$=0.7 indicates that the actual flow is 70% of the theoretical flow.
- A corollary of the above fact is that for a given gas flow, the valve must be bigger (and therefore heavier) than the ideal. Conversely, an ideal valve, were it possible, would be smaller (taking up less room in the cylinder head) than today's poppet valve.
- Since engine power closely correlates with breathing capacity, this encourages the use of the largest possible valves in a cylinder head which often brings the valve very close to the cylinder wall. This can be counter-productive because the proximity of the cylinder wall disturbs the gas flow, resulting in imperfect distribution and a breathing impediment.
- In compression ignition (CI, or Diesel) engines, at top dead center (TDC) the piston crown approaches the cylinder head fire-deck as closely as manufacturing tolerances will allow, typically with less than 2 mm clearance. This fact restricts the amount of gas-exchange valve overlap (the duration in crank angle degrees during which both inlet and exhaust valves are simultaneously open) that is possible in a 4-stroke engine if destructive piston-to-valve collision is to be avoided. In the past, for thermal loading reasons this limitation has been a serious impediment to engine durability and power output and may limit the potential for in-cylinder NOx reduction since scavenge flow assists in cooling the cylinder.
- An IOV must be designed with a large factor-of-safety associated with it, since intrinsically it is not "fail-safe". In the event that the valve or its retainer should fail mechanically, it will fall into the cylinder, causing serious derangement to that cylinder and possibly to the engine as a whole. This fact implies that the valve is likely to be more rugged and therefore heavier than might otherwise be necessary.
- Valve heads typically occupy a large percentage of the area of the combustion chamber fire deck. Since the IOV is cooled only indirectly, hot valve heads can precipitate premature detonation (uncontrolled ignition and burning), particularly in gasoline engines.
- For those engines that are adapted for compression braking (typically heavy-duty CI), a particularly robust valve train is required to open the IOV against cylinder compression pressure (approx. 50 bar). This fact has limited the adoption of cam-actuated compression retarders in medium-duty engines or below.

The negative aspects to the IOV notwithstanding, it has nevertheless been seen as a very satisfactory fit-for-purpose technological solution for today's engines. Indeed, the hegemonic position enjoyed by the inward-opening valve for the past century makes it seem impertinent, if not unwise, to suggest that it may not be the right solution for the future too. However, in the effort to meet certain future emission legislation, significant changes are coming to the internal combustion engine. These changes will alter the balance of technological attributes required, and in the process will make the inward-opening valve less suited to its use than has been the case in the past. As technology moves into the controlled auto-ignition regime of homogeneous charge compression ignition (HCCI), simply acting as gatekeepers for the inlet and exhaust strokes is no longer sufficient for gas-exchange valves. These valves also need to control effective compression ratio ($CR_{eff}$), and also the quantity of exhaust residuals remaining in the cylinder from the previous exhaust stroke (which may require multiple open/close valve events per cycle). Additionally, practical limits are being encountered with inward-opening valves as engine-specific power ratings increase.

It is beneficial to examine these situations individually in more detail.

Diesel Engine Power Growth:

The desire to increase engine specific-power density (expressed in terms of kW/liter) is pervasive in the industry. In this regard, the gasoline engine has always been dominant and has been the yardstick against which the diesel engine is compared, particularly in the light duty field. Heavy duty engines are typically sold on a "N-dollars per horsepower" basis, where more power within a given engine size category is also desired. It will be apparent that at any given engine speed, if more power is to be produced at the same or similar thermal efficiency, then more fuel must be burned in unit time. Given a similar combustion process, the distribution of the heat energy will be similar for each case considered, with proportionate increases in heat rejection to the exhaust and the cooling systems. Before that heat reaches the cooling system, the heat will be resident in the components most closely associated with the combustion chamber, that is to say, the piston crown and the cylinder head fire deck, including the valve heads. For the cooling system to remove that heat, there must be adequate cooling flow and straightforward heat transfer paths, particularly around the fuel injector and in the exhaust valve bridge region (the narrow section between the two exhaust valves). In the prior art, the desire for more power with its implications of larger valve diameters for better breathing and higher peak firing pressures has now come into conflict with cylinder head low-cycle fatigue (LCF) strength and thermal loading. As a result, to improve head strength and cooling, but to the detriment of breathing, new engines now being designed are obliged to have smaller valve sizes than were previously specified.

A further problem with IOV is that because early in the induction stroke the intake valve is obliged to lag the descending piston, IOVs create negative work for the piston until the valve flow area catches up with the piston rate of displacement. This undesirable throttling effect is discernable and can result in a fuel consumption penalty as great as 2%.

A solution to this dilemma is desired, although it must be pointed out that a smaller valve diameter is not a limitation of itself, since volumetric efficiency can be restored with an increase in inlet port flow capacity (higher coefficient of discharge, or $C_d$) where possible, or boost pressure, or both. Note however that boost pressure costs energy, and so a solution that does not require higher pressure is preferred.

Controlled Auto-Ignition, or HCCI:

Current engine designs have evolved over the last century in response to customer requirements, fuel availability, metallurgy, and other factors including emission legislation. For example, important driving factors currently are emissions, fuel consumption, durability, and minimized maintenance requirements. Legislation appears to be converging on a zero level of regulated exhaust emissions, and this situation is proving to be problematic for the conventional diesel engine, particularly with respect to nitrous oxide (NOx) emissions, and to a lesser extent with particulate material (PM) emissions. The conventional approach to this problem is to pursue the same path already taken by the gasoline spark ignition (SI) engine, which is to employ a comprehensive suite of exhaust gas aftertreatment (EGA) devices to the engine. The problem with this solution is that it is cumbersome and expensive, and works to put the CI engine at a greater cost disadvantage vs. the SI engine than it already occupies. Thus, another solution is desired.

An alternative solution that appears to be rapidly becoming the industry preference is to adopt one or more of the many advanced combustion concepts that are currently under development in the industry. Broadly, these concepts may be subdivided into those that retain conventional heterogeneous late-injection diffusion combustion (e.g. EPA "Clean Combustion"), and those that employ one or more early injections to enable a controlled auto-ignition (CAI), also known as HCCI. (See: Mello, J P and Linna, J R, "*Homogeneous Charge Compression Ignition*", TIAX LLC, 2003.) Both concepts require high levels of exhaust gas recirculation (EGR) back into the cylinder, but the latter approach is currently limited to about 50% of the brake mean effective pressure (BMEP) of the former since it is obliged to operate in a regime that is lean of the flammable range (>approx. 35:1 air/fuel ratio). HCCI has, however, demonstrated very low engine-out levels of NOx and PM, typically better than the first concept, and thus is an attractive path to pursue, particularly if the limited power potential issue can be overcome.

There are, however, many different "HCCI" strategies at this time and it is not clear which ones are likely to see widespread adoption. Nevertheless, a common feature of the advanced premixed auto-ignition combustion systems is that there is no positive initiation for the combustion event, as there is for the SI engine (the spark), or for the CI engine (the introduction of atomized fuel into hot compressed air). As such, other factors have to be manipulated to control the timing of the detonation which otherwise would occur well before TDC, resulting in undesirable negative work.

Assuming an engine of fairly conventional architecture operating on diesel fuel, the challenge is to postpone the start of combustion until just after TDC. Of the many published strategies to achieve CAI, a high level categorization would be between those that employ early injection(s) to achieve the necessary homogenization for clean combustion, and those that attempt late injection in which all the fuel is delivered during the "delay" period (that very short duration of time between the start of injection and the start of combustion). This latter approach has more in common with current engines, since it requires very high injection pressure in conjunction with a special multi-hole nozzle; however, achieving a homogeneous mixture in the short time available is extremely challenging, requiring a very expensive injection system. At the end of the day, the former approach is likely to win since it should be able to employ a much lower-cost injection system; however, both concepts, and particularly the latter, require start-of-combustion controls.

There are a number of parameters that can be manipulated to postpone combustion (when the engine is warm), or advance it (when the engine is cold), but chief among these are $CR_{eff}$ and EGR, as pointed out above. In a warm engine, an increase of cooled EGR in the charge will serve to delay combustion, while in a cold engine the exhaust gas heat will serve to advance combustion. Likewise, a lower numeric compression ratio will delay combustion while a higher ratio will advance it. A means to conveniently effect these changes is therefore required.

Within the engine prior art, it is generally perceived that these changes can be made through the active modulation of valve events, sometimes referred to as variable valve actuation (VVA); however, by far the majority of mechanisms that have been proposed for this purpose are much better suited for SI engines that in general do not have the valve-to-piston interference issues that typical CI engines do. Thus it appears that the current mindset within the industry, and therefore the focus of activity, is to adapt SI VVA systems for the CI engine rather than to approach the problem from first principles.

What is needed in the engine arts is a new valve and valve train mechanism that is better suited to enabling CAI conditions in the diesel engine, and at a cost that will not disadvantage the CI engine vs. its SI counterpart.

Desired Functionality:

The following is a brief review of the ideal functionality that a valve mechanism should possess. Recall that the objective for future engines is to deliver zero exhaust emissions with minimum fuel consumption, without giving up any of the desirable attributes of power and responsiveness that current engines provide. A number of new and little-used older strategies in addition to CAI that are being widely discussed within the industry are expected to be utilized to achieve the objective, and a common theme is that they all require WA. More specifically, the VVA needs to be particularly flexible so that more than just a single strategy can be employed, suggesting that valve "mobility" will be an important attribute in the future. Mobility in this context implies the freedom to open or close any intake or exhaust valve at any time in the cycle without undue difficulty or hindrance. Such freedom is clearly impossible in an IO interference engine.

In the same way that flexibility of injection characteristics provided by common rail fuel injection systems have revolutionized the diesel engine in recent years, so it is thought that flexibility in valve event timing will bring another step change improvement by enabling advanced strategies hitherto thought impossible. Among the strategies being discussed are included:

1. The Atkinson Cycle (Late Exhaust Valve Opening, or EVO, giving high expansion ratio).

2. The Miller Cycle (Early or late Intake Valve Closing, or IVC, to modify $CR_{eff}$ in conjunction with external compression).

3. The Air-Hybrid Cycle (Compression regeneration; see U.S. Pat. No. 6,223,846).

4. The Curtil Cycle (Pressure-wave supercharging technique utilizing VVA; see U.S. Pat. No. 5,819,693).

5. Two-stroke, four-stroke, six-stroke, eight-stroke switching.

6. Engine braking (Compression retardation).

Strategies 1, 2, and 3 are primarily aimed at fuel efficiency improvement; strategies 4 and 5 offer performance enhancement particularly in CAI mode; and strategy 6 extends the benefits of compression retardation to engines below the circa 2.0 liter/cylinder, heavy duty category that utilizes it today. An engine of conventional architecture but with a flexible VVA system would be able to adopt the Atkinson, Miller, and Curtil cycles under differing operating conditions, whereas air-hybrid and multiple stroke-switching engines would require additional complexity to function effectively. Note, however, that CAI/HCCI is possible today over a limited operating range with today's engines, but practical implementation is essentially technology-limited; the better and more flexible the technology, the more capable the engine will be.

These requirements suggest that in future CI engine design, thee will be a migration to camless valve trains that offer valve mobility with good refinement; minimal noise, vibration, and harshness (NVH); high reliability; and durability that is at least up to current standards, assuming it is not accompanied by excessive on-cost.

It is a principal object of the present invention to provide a gas-exchange valve system wherein the entire valve port is open to passage of gas therethrough.

It is a further object of the present invention to provide a way wherein camless engines may be confidently enabled.

SUMMARY OF THE INVENTION

Briefly described, an outwardly-opening (OO) gas-exchange valve for an internal combustion engine includes a port in a firing chamber in an engine head, the port having a valve seat on a side opposite from (outside of) the associated firing chamber. A poppet valve head in the form of a piston slides in a bore formed in the engine head concentric with the port and has a face for mating with the valve seat to occlude passage of gas across the valve seat. Withdrawal of the poppet valve head from the seat (opening of the valve) along the axis of the piston and cylinder opens the firing chamber to communication with an intake or exhaust manifold runner in the engine head. The poppet valve head may be actuated by any convenient means, for example, an overcenter lever arrangement having a high mechanical advantage and actuated selectively by hydraulic pressure or mechanical means.

A valvetrain in accordance with the invention is especially useful as a combustion air intake valvetrain, a combustion exhaust valvetrain, and/or an exhaust gas recirculation valvetrain.

In a presently preferred embodiment, a plurality of OO intake and exhaust valves are arranged in a hemispherical firing chamber formed in an engine head with their respective axes radially disposed.

BRIEF DESCRIPTION OF THE DRAWINGS

The present invention will now be described, by way of example, with reference to the accompanying drawings, in which:

FIGS. 6-1 and 6-2 are schematic drawings showing dual OO valves in accordance with the invention being operated by a single actuation mechanism;

Corresponding reference characters indicate corresponding parts throughout the several views. The exemplifications set out herein illustrate currently-preferred embodiments of the invention, and such exemplifications are not to be construed as limiting the scope of the invention in any manner.

DESCRIPTION OF THE PREFERRED EMBODIMENTS

The present invention is directed to an outward-opening valve and its actuating mechanism; that is to say, a valve that opens by moving away from the combustion chamber. The concept of OO valves for internal combustion engines is not new, and some recent prior art examples can be found (see, for example, U.S. Pat. Nos. 5,522,358 and 5,709,178), notably the latter to which the present invention disclosure has some superficial similarity. Prior art OO valvetrains are, however, relatively complex, having been designed with heavy-duty engines in mind, and a lower cost concept would be more likely to be considered for production, particularly for light and medium-duty engines, this being an objective of the present invention. The present invention may be applied to all gas exchange valves, either inlet or exhaust (including stand-alone EGR valves) as may be desired.

The benefits and advantages of OO valves in accordance with the invention may be better understood and appreciated by first considering the poppet valve properties of a typical prior art IO valve train.

Figure 1:
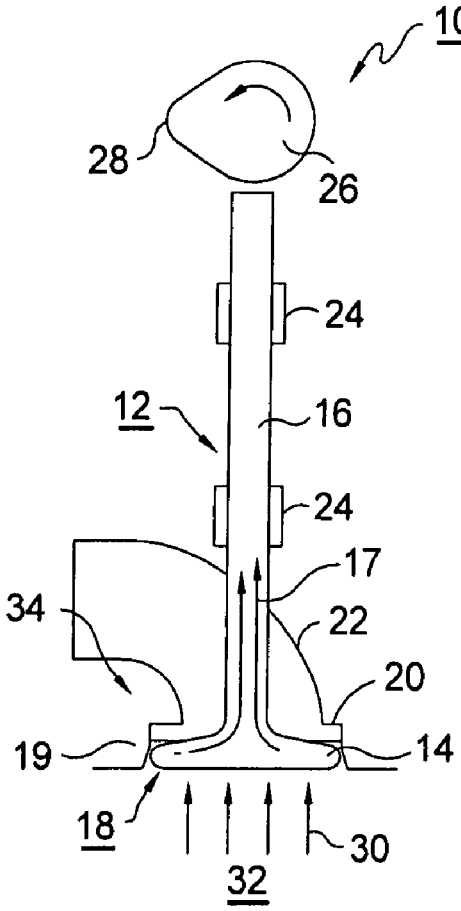
FIG. 1. (PRIOR ART)
FIGS. 1 and 2 are elevational cross-sectional views of a prior art IO valve train, shown in the valve-closed and valve-open positions, respectively.
Figure 2:
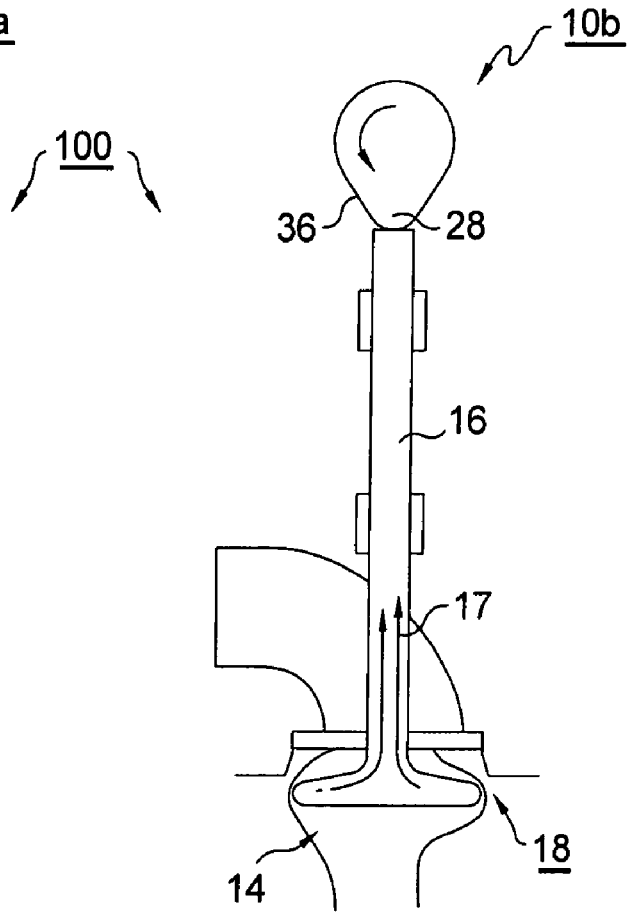
FIG. 2. (PRIOR ART)
Figure 3:
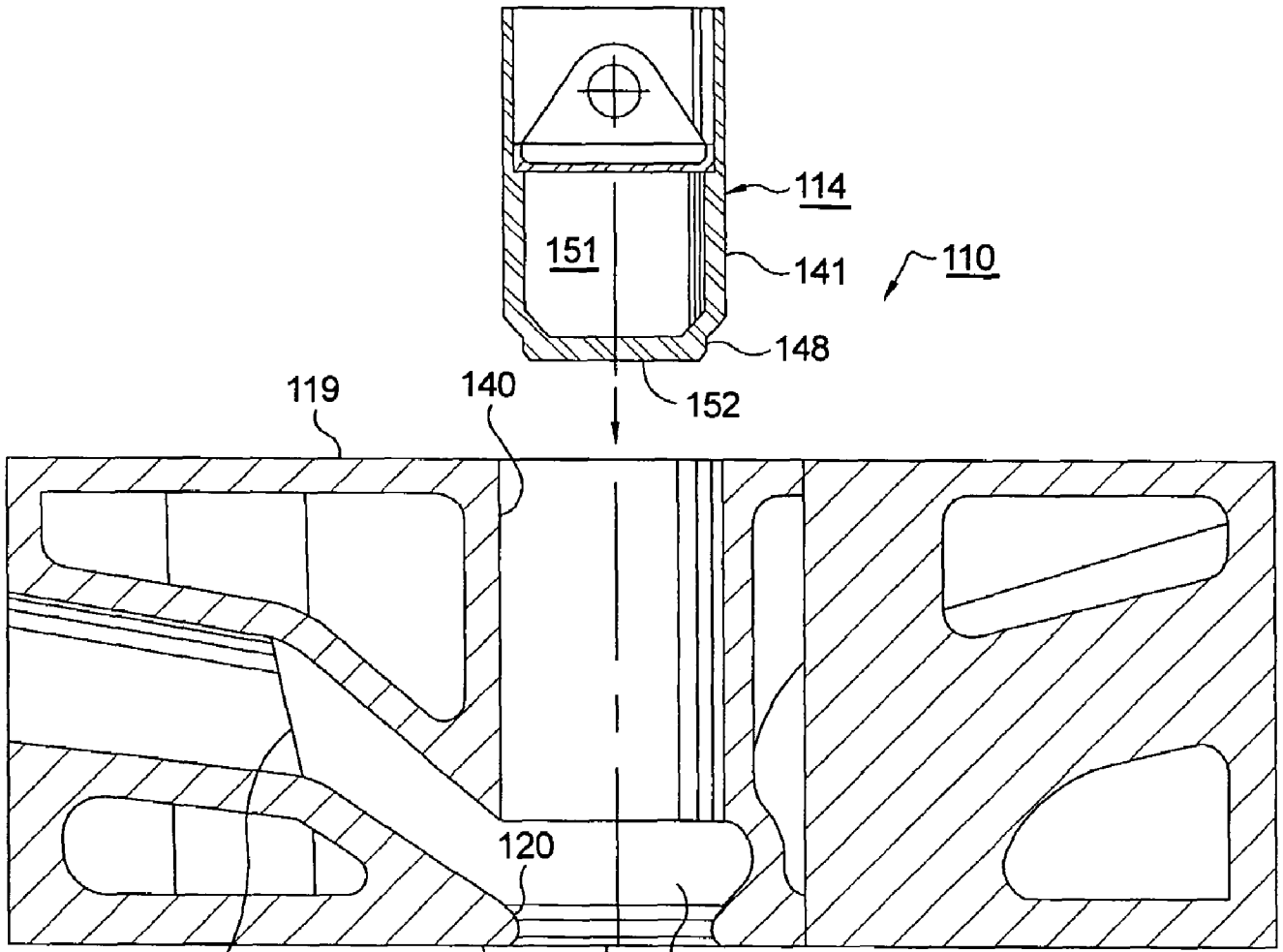
FIG. 3 is an elevational exploded cross-sectional view of a portion of a first embodiment of an OO gas-exchange valve in accordance with the invention.

Referring to FIGS. 1 and 2, a prior art poppet valvetrain 100 is shown in the valve-closed position 10*a* and the valve-open position 10*b*. A poppet valve 12 comprising a valve head 14 connected to a valve stem 16 is centrally disposed in a valve port 18 formed in a housing 19 configured for supporting the valve train such as an engine head. Port 18 is surrounded by a valve seat 20 against which valve head 14 may variably mate. Port 18 opens into a manifold runner 22 which may be either an intake air runner or an exhaust gas runner. Valve stem 16 is slidably supported by one or more bushings 24. A rotatable cam lobe 26 having an eccentric portion 28 actuates poppet valve 12 (return spring omitted).

Referring now to FIG. 1, gas, pressure, and heat 30 in an engine combustion chamber 32 hold valve head 14 tight against valve seat 20, making gas sealing relatively easy. However, the contact area 34 of the valve seat limits conductive cooling of the valve head through the engine head. Conductivity and diameter of the valve stem 16 limits conductive cooling 17 of the valve head via the valve stem. The valve stem must be very straight to seal properly at the stem bushings 24. A precise clearance to the base circle portion of the cam lobe 26 is required. The cam profile is difficult to manufacture precisely, and cam wear or manufacturing inaccuracies lead to rattling of the valve stem (or tappets, not shown).

Referring additionally now to FIG. 2, an exhaust valve head 14 runs at 700° C. or more. Even when the valve is fully open, the valve head and stem obstruct port 18.

Valve 12 needs controlled closing to avoid hammering of seat 20, typically by controlling the closing ramp 36 of the cam eccentric 28. For an exhaust valve, high force is required to push valve 12 open against combustion pressure 32 (FIG. 1). Sliding contact, although lubricated, between cam eccentric 28 and valve stem 16 creates parasitic friction, wear and heat.

The various negative features of an IO valvetrain just described are overcome by an OO valvetrain in accordance with the invention.

Referring now to FIGS. 3 through 6, in a first embodiment 110 in accordance with the invention, a hollow thin-walled steel plug or piston valve 114, analogous to prior art valve head 14, reciprocates in a bore 140 in a valve train housing 119, such as a cylinder head, that is slightly larger than the diameter of valve seat 120. Valve seat 120 surrounds a port 118 formed in the fire deck 142 of the cylinder head. A radius or chamfer may be applied to the interface between firedeck 142 and port 118, particularly in the case of the exhaust valves to improve the coefficient of discharge ($C_d$) of the gases evacuating from the cylinder relative to that obtained with a sharp conjunction. Within housing 119 and adjacent seat 120 is an annular space 144 through which the piston valve 114 moves, space 144 being connected to the inlet or exhaust port 146, as the case may be. The piston valve has a short obturator 148 that fills the space between the valve seat and the fire deck face when the valve is closed, having the objective of displacing and thus eliminating dead air within the combustion chamber that would otherwise occupy that space. This is beneficial for combustion since the air in pockets such as these is inaccessible to the fuel spray plumes from a fuel injector and thus plays no useful role in combustion. Further, the elimination of the pockets is beneficial to the maintenance of air swirl in the combustion chamber, resulting in improved fuel/air mixing and thus more complete combustion.

Figure 9:
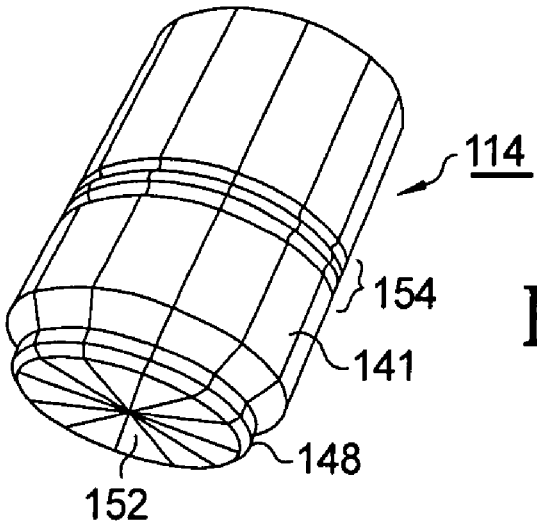
FIG. 9 is an isometric view of a piston-shaped poppet valve head for use in a valve train in accordance with the invention.

As is the case for conventional IO valves, the OO valve must lift by an amount that provides a curtain area 150 (FIG. 5, valve seat circumference multiplied by valve lift) that is at least as great as the valve seat cross-sectional flow area. Preferably, piston valve 114 is hollow and is partially filled with a thermally-conductive medium 151 such as sodium salts to aid cooling by transferring heat from the valve fire face 152 to the valve guide wall 141. Because of the large guide diameter in comparison with conventional valves, operation in the parent metal of an iron cylinder head is contemplated without the normally intervening valve guide. Preferably, labyrinth grooves 154 (FIG. 9) in the piston are provided to minimize blow-by of inlet or exhaust gases past the valve guide, although a piston ring (not shown) is also contemplated and may be necessary in some applications to prevent escape of boost or exhaust pressure to the valve chest area.

Figure 4:
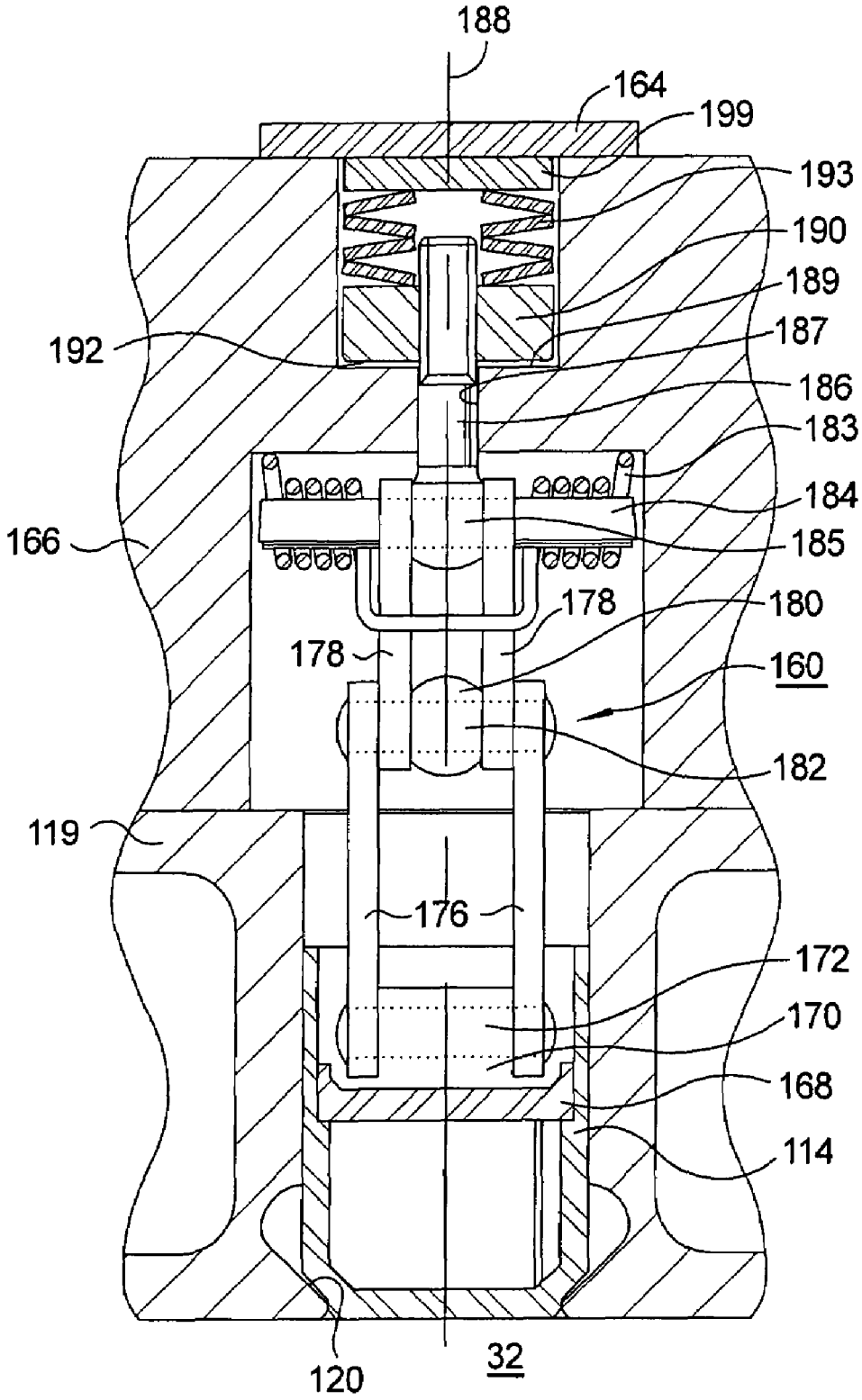
FIG. 4 is a first elevational cross-sectional view of an OO gas-exchange valvetrain in accordance with the invention.
Figure 5:
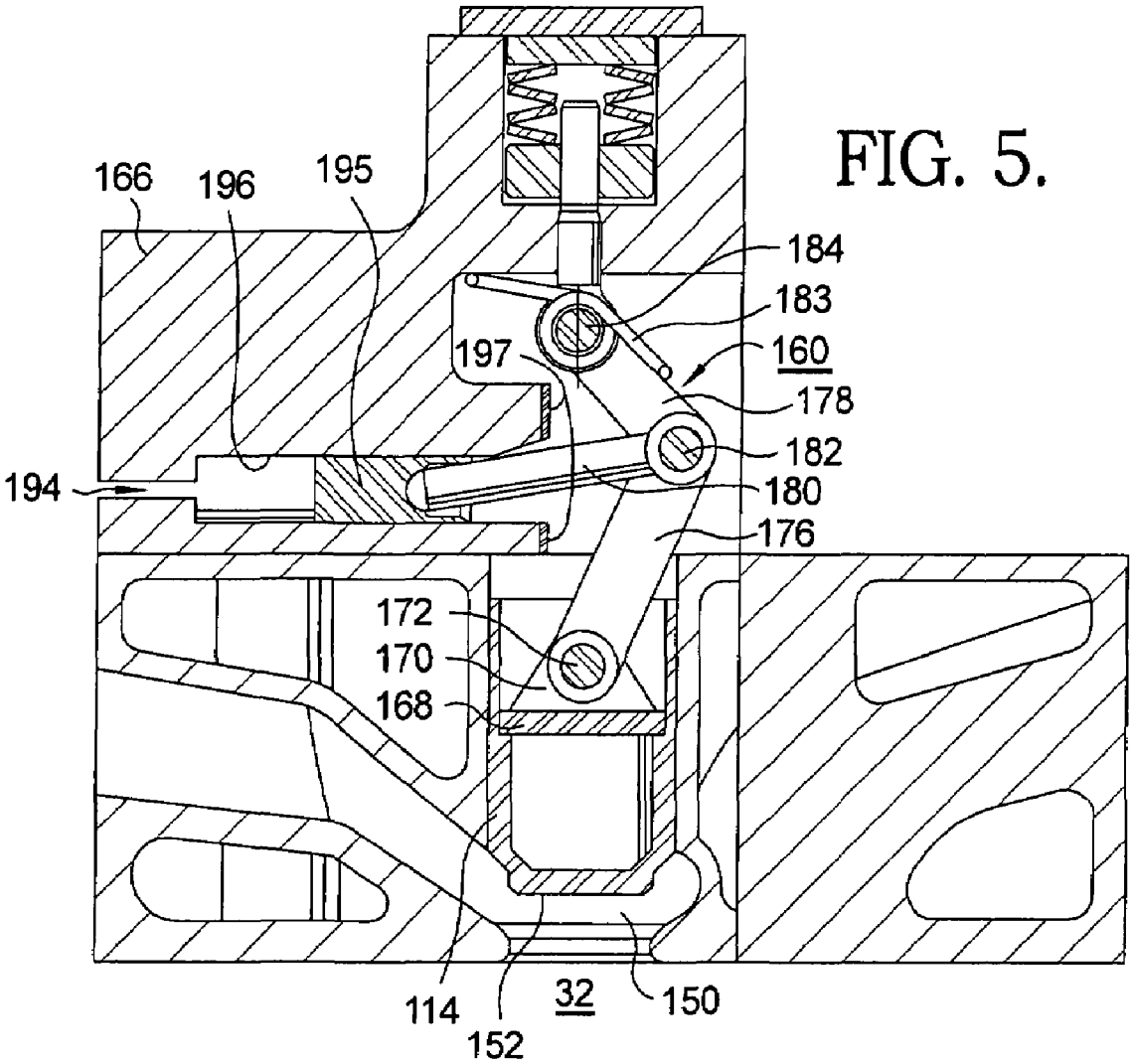
FIG. 5 is a second elevational cross-sectional view of the valvetrain shown in FIG. 4, taken orthogonal thereto, showing the valve in the open position.
Figure 6:
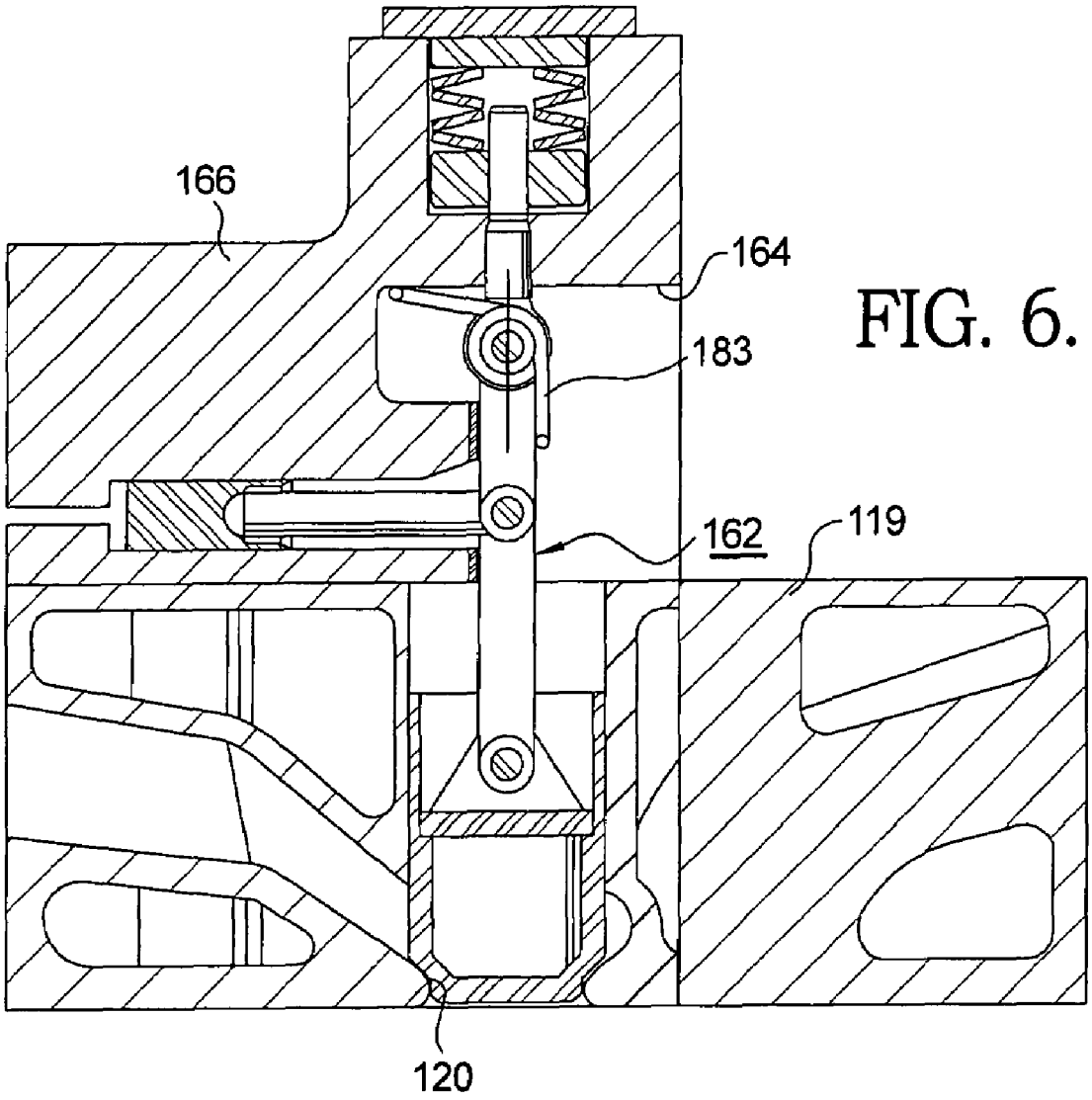
FIG. 6 shows the valvetrain of FIG. 5 in the valve-closed position.
Figures 1, 6:
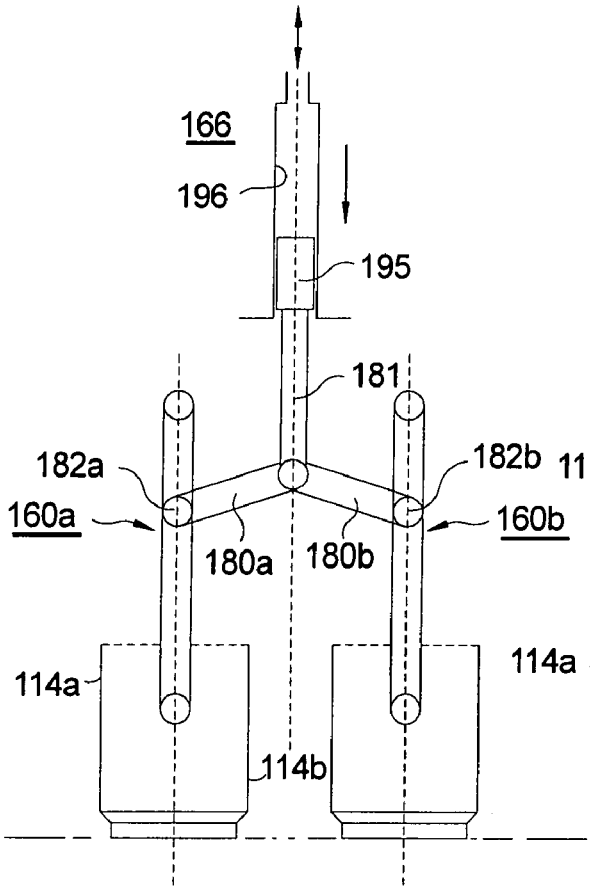
Figures 2, 6:
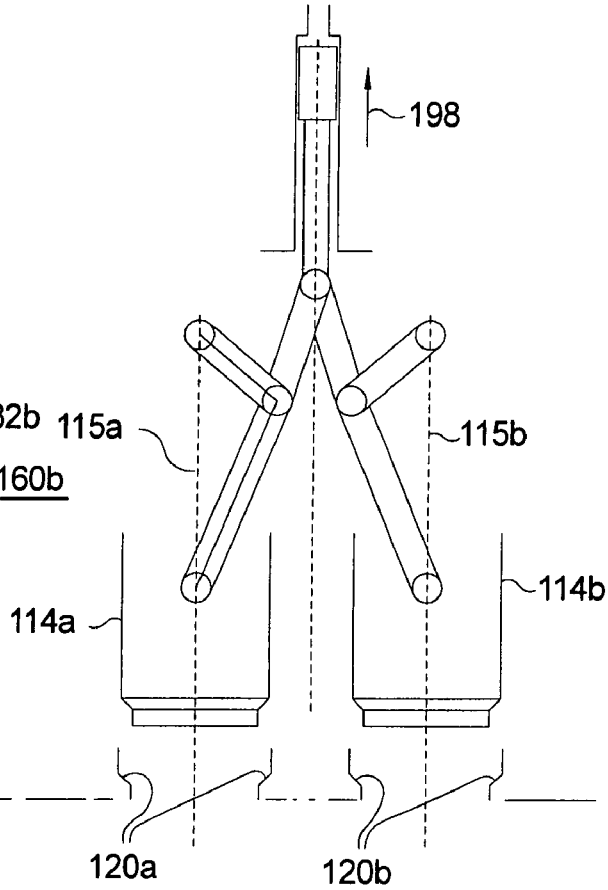

Referring now specifically to FIGS. 4, 5 and 6, to hold OO valve 110 closed against high cylinder pressures, a simple over-center scissor mechanism 160 is presently preferred, that when enabled forms a rigid strut 162 between valve seat 120 and an abutment 164 atop an actuator housing 166 adjacent housing 119. (Although actuator housing 166 is disclosed and discussed as an independent entity, it is a functional part of the cylinder head and is treated as such in the claims.) The load path runs up the valve from the seat through the walls of valve 114 to a sub-component 168 that acts to both cap the hollow cavity and to provide the bearings 170 for a linkage hinge pin 172. The linkage 174 is similar in concept to the familiar roller chain, but the two link pairs 176,178 are of different lengths, the lower link being longer. At the intermediate hinge point, a connecting rod 180 is arranged perpendicular to an intermediate hinge pin 182, and is in association with an actuator (see below) for control of valve position. The shorter top link pair 178 is spring-biased into the rigid-strut valve-on-seat position 162 by a torsion spring 183 coiled around the top hinge pin 184 that passes through the eye 185 of a threaded rod 186 that in turn passes through a vertical guide bore 187 in actuator housing 166 that is aligned with the valve axis 188. In a pocket 189 above the guide bore, an adjustable ring 190 is threaded to rod 186, the ring being so arranged that when the linkage is rigid with the valve hard upon its seat, there is a small gap 192 of, for example, 0.25 mm between pocket 189 and ring 190. Gap 192, which may be varied by the adjusting mechanism just described, is intended to accommodate wear, thermal expansion, and setting error, is analogous to the valve clearance of a conventional valve train, and is set during engine assembly.

Also in pocket 189 and loading adjustable ring 190 is a resilient component 193, such as for example, a Belleville washer (but other spring devices such as a helical spring, hydraulic pressure, pneumatic pressure, or an elastomeric medium (not shown) are alternatively contemplated) to which a load force is applied by screw or shim adjustment 199 between ring 190 and abutment 164. The load force may also be a force that can be varied depending on engine operating conditions. This force is equal to or greater than the product of valve area multiplied by the anticipated peak cylinder pressure, so that valve 114 stays seated under all normal operating conditions. The preload can of course be calibrated to permit the valve to open should the cylinder pressure exceed a predetermined maximum. By this means, a known maximum structural loading can be designed for the engine block and head, safe in the knowledge that the valve will blow-off if the threshold pressure is exceeded, hence confidently permitting a lower margin of safety and a lighter engine structure than is currently the case in prior art engines.

Any of several means of actuation of the valve train are contemplated, but in the preferred embodiment an electro-hydraulic "camless" system is described. A source of hydraulic or pneumatic pressure 194 is generated, and in conjunction with appropriate valving (not shown), this pressure is caused to displace a piston 195 disposed in a transverse bore 196 in actuator housing 166 and with it, the connecting rod 180 and scissor mechanism 160. Alternatively, any obvious mechanical mechanism may be employed to displace piston 195.

It will be recognized that with the valve on its seat, the over-center linkage is very heavily loaded (for example, 200 bar cylinder pressure acting upon a 25 mm diameter valve will result in a load of almost 10 kN); however, a very much lower force is required to lock and unlock the mechanism from the on-center position.

Turning now to the operation of the valve mechanism, it will be understood that the default position for the valve will be on its seat with the linkage mechanism either "on-center" or just "over-center", being so positioned due to the coercion of the torsion spring acting upon the upper link. In this condition, valve 114 is loaded upon its seat 120 by the preload spring 193 at the top of the linkage stack, and a small clearance gap 192 exists between the adjusting ring and the floor of spring pocket floor 189. In the combustion chamber 32, a smooth surface is presented to the swirling air since there are no valve pockets in the piston crown or valve recesses in the fire deck. This permits the desired air motion to be better sustained through the compression stroke and into the combustion event. Additionally, without such dead air pockets, the air utilization (percentage of air that can be accessed by the fuel spray and thus participates in the combustion) is markedly increased.

During and following combustion, heat from the conflagration is transferred into the valve through its face, whence it can escape either through the adjacent valve seat 120 into the cooled valve train housing 119 or through the molten sodium salts of medium 151 within the hollow piston valve that are in constant agitation and thence to the side walls and valve guide bore.

When a valve event is required, for instance EVO at the end of the exhaust stroke, the valve actuator (e.g., hydraulic pressure 194 and piston 195) acting through the connecting rod 180 pushes the linkage of scissor mechanism 160 aside so that it is no longer an on-center rigid strut, as shown in FIG. 6. Initially, the clearance gap 192 in the preload pocket is taken up, but once that has happened, further motion of actuator rod 180 serves to raise the valve from its seat. The valve is assisted in this action by the extant cylinder pressure acting upon the valve face, and thus the actuating force is essentially that which is required to overcome the bias spring. When the valve reaches full lift (FIG. 5), the fire face 152 of the valve becomes essentially the roof of an open cavity surrounded by an annulus space 144, affording unobstructed access (in the case of an exhaust valve) for the exhaust gases to the exhaust port. Upon deactivation of the valve actuator, the torsion spring 183 returns the mechanism to its default position (FIG. 6). It will be noted that due to the kinematics of the linkage, the valve seating velocity is inherently low, being beneficial for low NVH and valve seat wear. Also, in returning to its default position, the linkage is arrested by a pad 197 of resilient material such as neoprene or other engineering polymer as a means to minimize noise.

This same sequence of events takes place, whether the valve in question is an intake valve or an exhaust valve, and whether the function is a conventional valve event or an atypical event such as engine braking or a Curtil event. No details are provided here concerning the electro-hydraulic valve actuating system since a conventional system without novelty is assumed. Although described with a single-acting hydraulic actuator, other embodiments are contemplated including an arrangement wherein the mechanism is spring-biased open and energized closed, and a double-acting actuator in which case the torsion return spring may be eliminated.

Referring now to FIGS. 6-1 and 6-2, many contemporary engines, and especially CI engines, employ two intake and/or two exhaust valves per cylinder. In dual IO valve systems, it is well known to provide a bridge between, for example, adjacent dual valves, and to provide single actuation means to the common valve bridge to save weight and cost. An exemplary analogous system for dual OO valves is shown in FIGS. 6-1 and 6-2. Other systems performing the same function will occur to those of ordinary skill in the mechanical arts and are fully comprehended by the present invention.

First and second valve heads 114*a*,114*b* are connected respectively to adjacent scissor mechanisms 160*a*,160*b*, as described individually above. Connecting rods 180 are replaced by first and second scissor arms 180*a*,180*b* connected individually at first ends thereof to first and second intermediate pivot pins 182*a*,182*b* and jointly at second ends thereof to an actuator rod 181 connected to a piston 195 in a bore 196 in actuator housing 166. Piston 195 is actuated identically to piston 195 in FIGS. 5 and 6. It will be seen that retraction of piston 195 upwards 198 causes folding of linkages 160*a*,160*b*, thus withdrawing valve heads 114*a*, 114*b* for their respective valve seats 120*a*,120*b*.

The arrangement shown will cause the valves to be normally open; however, a similar arrangement wherein rod 181 is longer and the scissor arms 180*a*,180*b* are driven downwards to open and drawn upwards to close will cause the valves to be normally closed. Also, of course, the actuation mechanism shown may be double-acting.

Note that valve axes 115*a*,115*b* are shown as being parallel. This is not a requirement, however, and the actuation arrangement shown in FIGS. 6-1 and 6-2 also may be used to advantage in radially-disposed valve pairs as described below and shown in FIG. 8.

Alternative Constructions:

Most high speed CI engines require a controlled level of air motion in the combustion chamber to aid in the mixing of the air, the fuel, and the EGR. This air motion typically comprises both swirl (rotation around the cylinder axis) and squish (a radial in-flow), and it has been found that the optimum level of swirl typically varies with engine speed. Thus some means to effect this change in swirl level is desired so that it may be optimized over the engine operating range.

Figure 7:
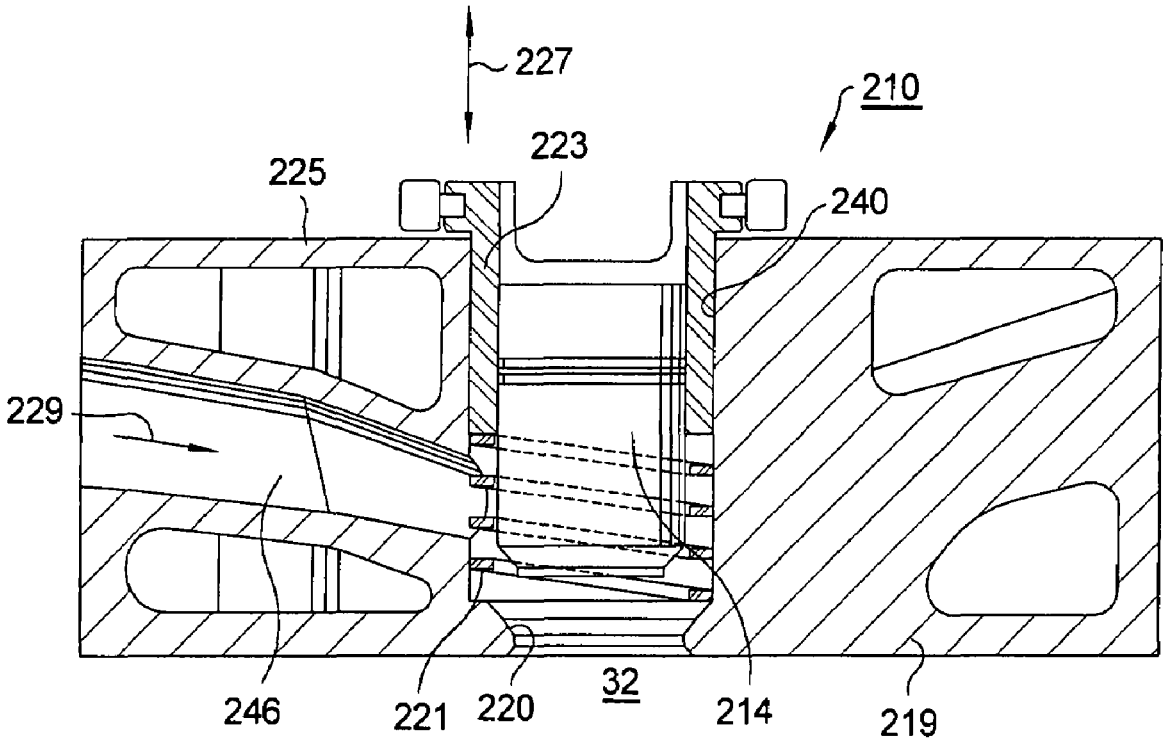
FIG. 7 is an elevational exploded cross-sectional view of a portion of a second embodiment of an OO gas-exchange valve in accordance with the invention.

Referring to FIG. 7, in a second embodiment 210 of an OO valve assembly, the diameter of pocket bore 240 for the inlet valve 214 in the valve train housing 219 is larger than the diameter of valve seat 220. Specifically, the bore diameter should be equal to or greater than the area occupied by the valve plus the area of the valve port in the fire deck, so that flow area is not restricted. Into pocket bore 240 is placed a helical spring 221, the wire section of which is preferably rectangular. The outside diameter of spring 221 is a slip fit in the pocket bore, and the internal diameter of spring 221 is a close fit to the OD of valve 214. Above this spring there is a bearing sleeve 223, also a slip fit in the pocket bore, that extends out and above the top deck 225 of the head 219. Sleeve 223 acts as a guide for the axial motion of valve 214, and has a limited vertical motion 227 itself within pocket bore 240, which motion has the effect of changing the pitch of spring 221.

In operation, charge air 229 from the inlet manifold enters the inlet runner and port 246, whence it encounters the valve surrounded by the helical spring. To enter the firing chamber 32, the air is obliged by the spring to circulate around the periphery of the valve, such that an intense helical motion is imparted to air 229 as it passes through the port, and this motion of the air is sustained as it fills the cylinder. Precise variation of the swirl ratio may be made by causing the bearing sleeve to move axially, having the effect of changing the spring pitch angle and thus the helix encountered by the incoming air. The axial position of bearing sleeve 223 will be modulated in the preferred embodiment by any one of many well known prior art actuators (not shown) that can be controlled electronically. In FIG. 7, bearing sleeve 223 is shown essentially fully depressed within bore 240, resulting in high swirl imparted to air 229. This technique is in stark contrast to current engines that control air swirl through the relatively crude expedient of throttling air flow through one of the two inlet ports wherein the two ports have different swirl characteristics, and one characteristic is allowed to dominate the other depending on the position of a throttle valve in one of the ports.

As noted in the Background of the Invention, in the case of medium- and heavy-duty diesel engines being designed today, a limitation has been reached in which thermal loading and low-cycle fatigue concerns are causing valve sizes to shrink relative to previous engine generations. The need to maintain cylinder head strength as cylinder firing pressures increase is causing a reduction in free-breathing capacity.

Figure 8:
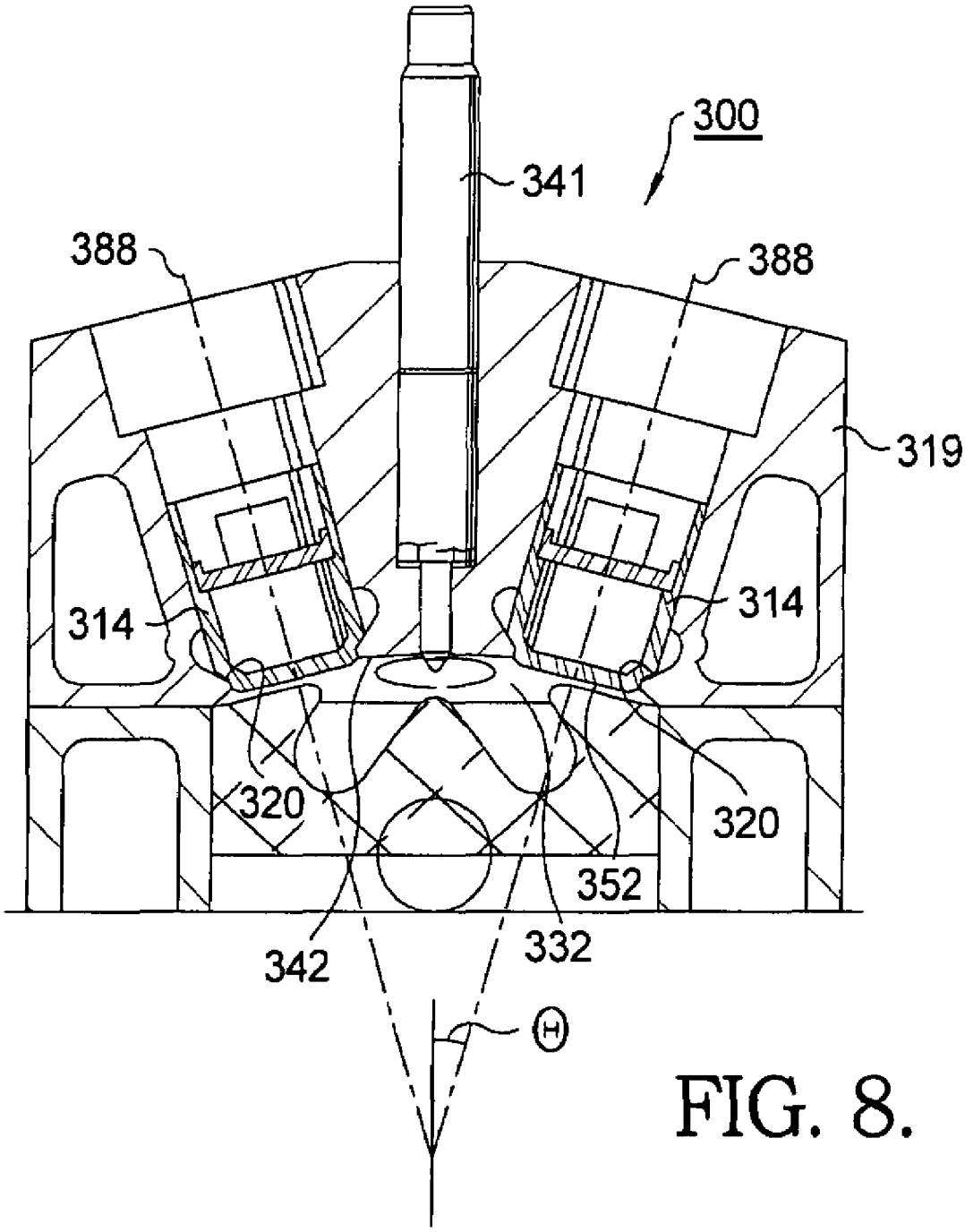
FIG. 8 is an elevational cross-sectional view of the upper portion of an internal combustion engine having a hemispherical firing chamber and having two radially-disposed OO valves in accordance with the invention.
Figure 10:
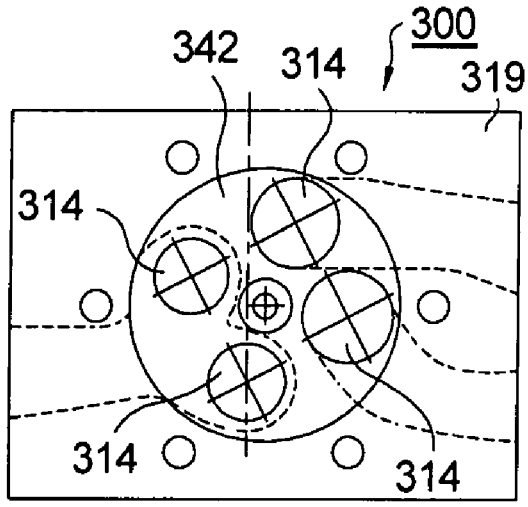
FIG. 10 is a plan view of the firing deck of a four-valve firing chamber having radial valves in accordance with the invention.

Referring now to FIGS. 8 and 10, a logical step that can be taken to improve both cylinder head strength and valve flow area in multiple-valve engines is to move from the current paradigm of four vertical valves having parallel axes to a radial valve embodiment 300, in which the valve axes 388 depart the hemispherically-domed combustion chamber 332 and fire deck 342 at a compound angle θ from the vertical, preferably about 15°. This geometry, which has occasionally been adopted in the past (see, for example, Reguiro, J F., "*Rotular Tappet Valve Trains for Hemispherical Combustion Chambers*", SAE Paper No. 960058, 1996.) by competition engines, has never become widespread due to the inordinate valve train difficulties of accommodating the compound angles, and also to cylinder head machining difficulties. This latter arises because with inward-opening valves, the valve seats are perforce machined into the head from the fire deck side, and since the valve axes converge, it is possible to machine only one valve bore and seat at a time instead of all four together as would be preferred.

Revisiting this situation now but with OO valves 314 in mind, the following factors are observed:

1. The doming of the combustion chamber 332 improves fire deck strength.

2. The radial format opens up space in the center of the valve train housing 319 for improved coolant flow around the injector 341 and valves to address thermal loading and conduction.

3. The radial format allows larger valves than is possible with a flat fire deck without invoking the sidewall flow interference mentioned previously, for enhanced breathing.

4. The improved flow coefficient of the OO valve coupled with the larger valve potential pen head strength.

5. With OO valves, the machining problem mentioned above is eliminated since the valve seats 320 are machined from the top; thus, all seats can be machined in one pass again permits a trade-off to be made between improved flow and improved head strength.

6. Because the choice of OO valves eliminates the potential for valve to-piston collisions, adoption of camless valve trains is encouraged. In turn, camless mechanisms resolve the kinematic problems with radial valve trains. Together, they are positively synergistic.

Unique Features Accruing to the Outward-Opening Valve:

1. The valve is hollow, light weight, and partially filled with sodium salts for cooling.

2. The valve is surrounded by an annulus which helps to minimize the valve lift necessary for maximum flow.

3. By eliminating the valve head and stem of a conventional inward-opening valve, the flow coefficient is better, permitting smaller valves for the same air flow.

4. Because the valve cannot fall into the cylinder, the arrangement is essentially "fail-safe", and thus can be made lighter than a comparable 10 valve.

5. The need for recessed valve heads and/or valve pockets in the piston crown is eliminated, to the benefit of in-cylinder swirl, air utilization, and combustion efficiency.

6. There is no possibility of valve-to-piston collision, thus enabling robust camless operation.

7. In contrast to conventional IO valve trains, the mechanism can be lighter since cylinder pressure assists valve opening, particularly in the case of early EVO or engine braking events.

8. Valve opening velocity is no longer constrained by piston position or velocity, resulting in lower pumping losses along with improved engine braking performance.

9. A peak cylinder pressure safety-valve feature is readily accommodated.

10. Preferably, the fire face 352 of each piston valve 314 is hemispherically dished at the same radius as the fire deck 342 to provide a virtually unbroken arcuate surface with the fire deck.

11. Because the piston-shaped poppet valve is physically constrained by a linkage, better spatial control is possible in contrast to a conventional IO poppet valve that at high speed has a tendency to follow a ballistic trajectory and thus depart from its intended motion.

12. In comparison with the slim valve stems of conventional prior art IO valves, the larger surface area of the external guide diameter of the OO valves 114, 214, 314 provide a better heat transfer pathway from fire face 152 to cylinder head 119, 219, 319.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A gas-exchange valvetrain for controlling the flow of gas between a gas manifold and a combustion cylinder of an internal combustion engine, said valvetrain being supported by a valve train housing of the engine, comprising:

a) a valve chamber in communication with said gas manifold;

b) a port configured for passage of gas between said valve chamber and said combustion cylinder;

c) a valve seat surrounding said port and facing away from said combustion cylinder;

d) a first bore formed coaxially with said port and valve seat;

e) a poppet valve head slidingly disposed in said first bore for reciprocally moving through said valve chamber into and out of mating contact with said valve seat to vary gas flow between said combustion cylinder and said valve chamber;

f) an abutment disposed at an end of said first bore;

g) a scissor mechanism pivotably attached at a first end to said poppet valve head and disposed between said poppet valve head and said abutment which, when said scissor mechanism is fully extended, defines a rigid linear strut for urging said poppet valve head in a direction toward said combustion cylinder into a valve-closed position against said valve seat, and when collapsed urges said poppet valve head in a direction away from said valve seat into a valve-open position; and h) an actuator mechanism for actuating said scissor mechanism.

2. A valvetrain in accordance with claim 1 wherein said actuator mechanism for actuating comprises:

a) a connecting rod attached to said scissor mechanism at an intermediate hinge thereof for actuating said scissor mechanism to move said valve head between said valve-closed position and said valve-open position; and b) an actuator for displacing said connecting rod.

3. A valvetrain in accordance with claim 1 further comprising a gap adjuster disposed between said scissor mechanism and said abutment.

4. A valvetrain in accordance with claim 3 wherein said gap adjuster includes a shaft extending from an end of said scissor mechanism, a ring positionally adjustable along an axis of said shaft, and a biasing member disposed between said ring and said abutment.

5. A valvetrain in accordance with claim 4 wherein said biasing member is selected from the group consisting of a coil spring, a Belleville washer, hydraulic pressure, pneumatic pressure, and an elastomeric medium.

6. A valvetrain in accordance with claim 1 wherein said chamber includes an annular portion concentric with said port and valve seat.

7. A valvetrain in accordance with claim 1 wherein said poppet valve head includes a cavity therein for receiving materials to aid in heat transfer.

8. A valvetrain in accordance with claim 7 wherein said materials are sodium salts.

9. A valvetrain in accordance with claim 1 wherein said scissor mechanism further comprises a spring configured for returning said scissor mechanism from said valve-open position to said valve-closed position.

10. A valvetrain in accordance with claim 1 wherein said poppet valve head further comprises an obturator for extending through a wall of said valve train housing to substantially fill said port when said valve is closed.

11. A valvetrain in accordance with claim 1 wherein said valvetrain is selected from the group consisting of combustion intake valvetrain, combustion exhaust valvetrain, and exhaust gas recirculation valvetrain.

12. A valvetrain in accordance with claim 2 wherein said actuator for displacing said connecting rod includes hydraulic pressure.

13. A valvetrain in accordance with claim 1 wherein said valve train has a first axis, and wherein said combustion chamber includes a hemispherical fire deck, and wherein said first valvetrain axis is disposed radially of said hemispherical fire deck.

14. A cylinder head for an internal combustion engine comprising:

a) a firing chamber defined by a fire deck; and b) a plurality of valve trains disposed in said cylinder head, each of said valve trains including c) a valve chamber formed in said cylinder head, d) a port extending from said fire deck through a wall of said cylinder head for passage of gas between said valve chamber and said firing chamber, e) a valve seat surrounding said port and facing into said valve chamber, f) a first bore formed in said cylinder head coaxially with said port and valve seat, g) a poppet valve head slidingly disposed in said first bore for reciprocally moving through said valve chamber into and out of mating contact with said valve seat to vary gas flow between said firing chamber and said valve chamber, h) an abutment disposed at an end of said first bore, i) a scissor mechanism pivotably attached at a first end to said poppet valve head and disposed between said poppet valve head and said abutment which, when said scissor mechanism is fully extended, defines a rigid linear strut for urging said poppet valve head in a direction toward said firing chamber into a valve-closed position against said seat, and when collapsed urges said poppet valve head from said seat in a direction away from said firing chamber into a valve-open position, and j) an actuator for actuating said scissor mechanism.

15. A cylinder head in accordance with claim 14 wherein each of said valvetrains has a longitudinal axis defining a plurality of longitudinal axes, and wherein said firing chamber is hemispherical, and wherein said plurality of longitudinal axes are radially disposed with respect to said hemispherical firing chamber and fire deck.

16. A cylinder head in accordance with claim 15 wherein each of said piston-shaped poppet valve heads includes a fire face, and wherein each of said plurality of fire faces is hemispherically formed at substantially the same radius as a radius of said hemispherical firing chamber.

* * * * *